United States Patent [19]

Kraft

[11] 4,050,321

[45] Sept. 27, 1977

[54] MULTI V-GROOVED PULLEY STRUCTURE AND METHOD OF MAKING SAME

[75] Inventor: Derald H. Kraft, Canton, Ohio

[73] Assignee: Aspro, Inc., Canton, Ohio

[21] Appl. No.: 666,931

[22] Filed: Mar. 15, 1976

[51] Int. Cl.[2] ..... F16H 55/44; B21D 53/26

[52] U.S. Cl. ..... 74/230.8; 29/159 R

[58] Field of Search ..... 74/230.8; 29/159 R

[56] References Cited

U.S. PATENT DOCUMENTS

| | | | |
|---|---|---|---|
| 3,831,366 | 12/1974 | Jacobs | 29/159 R |
| 3,935,627 | 2/1976 | Wolbert | 29/159 R |
| 3,962,926 | 6/1976 | Kotlar | 74/230.8 |
| 3,977,264 | 8/1976 | Sproul | 74/230.8 |
| 3,994,181 | 11/1976 | Sproul | 74/230.8 |
| 3,995,474 | 12/1976 | Kraft | 29/159 R X |

*Primary Examiner*—Leonard H. Gerin
*Attorney, Agent, or Firm*—Frease & Bishop

[57] ABSTRACT

A one-piece, sheet metal multi V-grooved pulley has a circular hub wall integrally connected with a cylindrical side wall, which side wall terminates in an open end opposite of the hub wall. A series of outwardly opening V-shaped grooves is formed by pairs of V-shaped flange walls in the cylindrical side wall. The pairs of flange walls decrease in metal thickness progressively from the hub wall toward the open end.

The V-grooved pulley is made by forming a cup-shaped stage blank having a bottom hub flange wall and a connected outer cylindrical wall terminating in an open end. The stage blank is formed by roller spinning an outer annular portion of a sheet metal disc along a stepped cylindrical surface of a headstock die. A series of integrally connected cylindrical surfaces is formed along the interior of the cylindrical wall of the stage blank by the roller spinning operation. The metal thicknesses of the cylindrical cup wall sections defined by the stepped surfaces decrease in a step-like fashion progressing from the hub flange wall toward the open end. A series of V-shaped grooves then is cold rolled in the cylindrical wall by inwardly displacing the center of each of the stepped cylindrical wall sections to provide pairs of V-flanges which form the V-shaped grooves. Each cylindrical wall section of the series provides the metal for the pair of V-flanges which forms the V-shaped grooves, whereby the metal thickness of the V-flange pairs decrease progessing toward the open end of the pulley.

18 Claims, 15 Drawing Figures

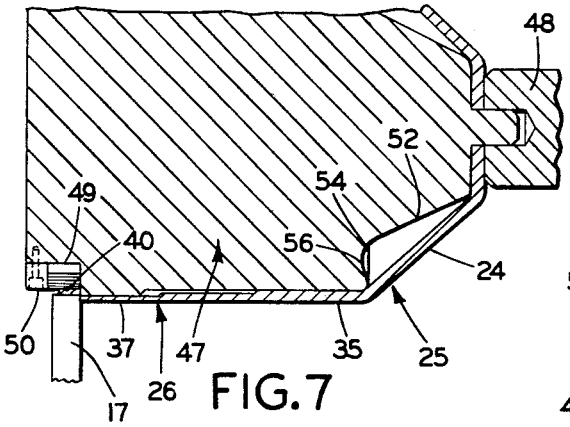
FIG.7
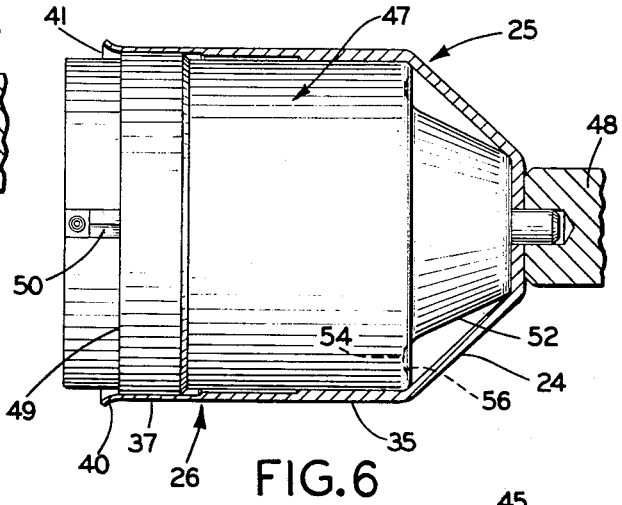
FIG.6
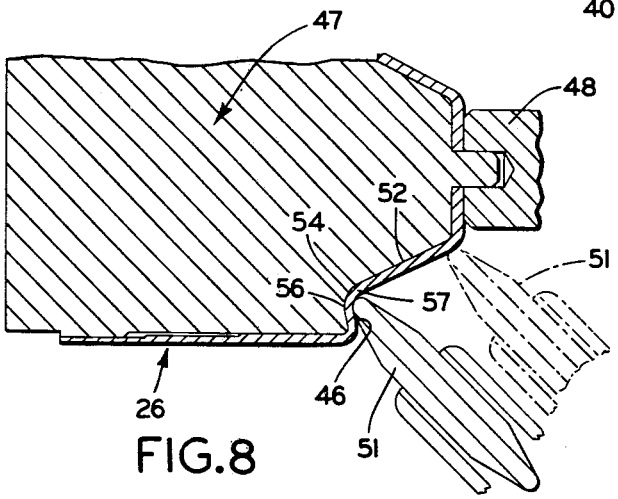
FIG.8
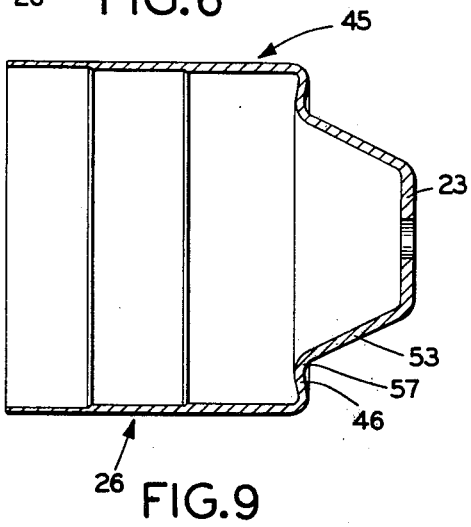
FIG.9
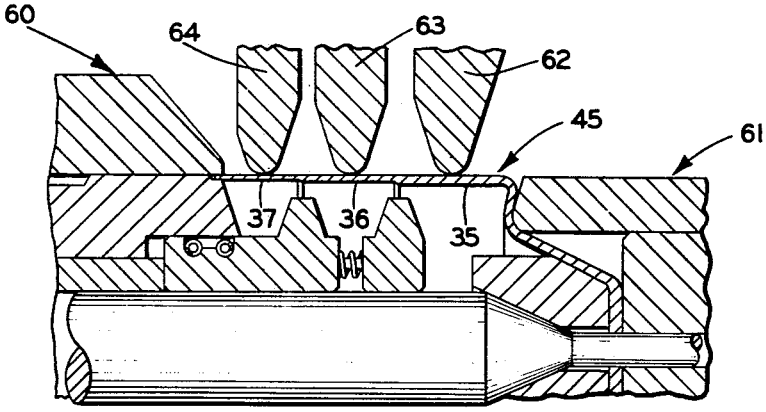
FIG.11
FIG.10
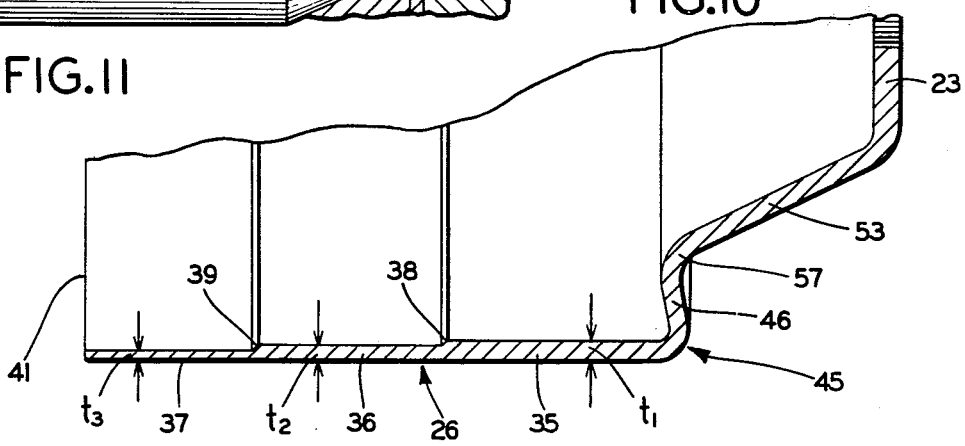

MULTI V-GROOVED PULLEY STRUCTURE AND METHOD OF MAKING SAME

BACKGROUND OF THE INVENTION

1. Field of the Invention

The invention relates to multi V-grooved sheet metal pulleys, and particularly to a new sheet metal multi V-grooved pulley structure having a plurality of pairs of roller spun coldworked groove-forming flange walls which form the V-grooves therebetween; and in which the metal thicknesses of the flange walls decrease progressively from the pulley hub flange wall.

The invention relates further to a new combination of steps by which such a multi V-grooved sheet metal pulley may be made to provide a series of groove-forming walls in a one piece cup-shaped sheet metal blank, in which the metal thickness of the groove-forming walls decrease progressively away from the hub wall.

2. Description of the Prior Art

Many procedures have been used and are known for the formation of V-grooved sheet metal pulleys from flat sheet metal discs. Many of these procedures involve stamping and drawing operations to produce at least the cup-shaped blanks from which the V-grooved pulleys are subsequently roller spun. Examples of such stamping and drawing operations are shown in U.S. Pat. Nos. 2,493,053 and 3,080,644.

Finished V-grooved pulleys or the cup-shaped stage blanks for subsequent spinning into V-grooved pulleys which are produced by such prior stamping and drawing methods are not balanced dynamically since the pulleys and blanks are formed by a series of progressive die steps on a non-rotating blank.

Many of these problems have been eliminated by the metal spinning procedure set forth in my copending application Ser. No. 584,388, filed June 6, 1975, in which a dynamically balanced cup-shaped metal blank is formed by roller spinning a disc against a headstock die, into which blank then is roller formed a plurality of pulley V-grooves. A cup-shaped stage blank produced by this method has a circular hub wall and a cylindrical cup wall with generally uniform metal thickness throughout the axial length. Subsequently, the flange walls forming the V-grooves which are in the cylindrical wall have equal thicknesses for each pulley groove.

In most equipment where such multi V-grooved pulley structures are used, the forces which are experienced by the individual V-grooves, decrease progressively along the cylindrical pulley wall in a direction away from the circular hub flange wall. Thus, the flanges which form the pulley groove immediately adjacent the hub wall experience greater stresses and forces than do the V-groove forming flanges which are located further axially along the cylindrical wall from the hub flange wall. Correspondingly, the outermost V-groove forming walls or flanges experience the least amount of force and stress thereon. Due to these conditions, the metal thicknesses or strength of the outer endmost pulley groove flanges need not be as great as the innermost pulley groove flanges. Therefore, most known pulley structures have more metal in the outer V-groove forming flanges than necessary, which increases the cost of the pulley.

Accordingly, there exists the need for a new multi V-grooved pulley structure and a method of making such a pulley which provides sufficient strength and rigidity to the groove forming flanges without excess metal being used in forming the outermost flanges.

SUMMARY OF THE INVENTION

Objectives of the invention include providing a new one-piece, dynamically balanced, sheet metal pulley structure having a cylindrical wall terminating at one end in a hub flange wall and an opposite open end, and in which a plurality of V-grooves are formed in the cylindrical wall by flange wall pairs, which flange walls decrease in metal thickness progressing outwardly from the hub flange wall toward an open end; providing a new pulley structure resulting in metal savings and weight reduction since the diameter of the starting metal disc blank can be reduced from that of a disc blank heretofore used to produce prior multi V-grooved sheet metal pulley structures in which the pulley groove flange-forming walls are of equal metal thicknesses; providing such a new pulley structure in which the grooved pulley flange wall pairs decrease in metal thicknesses progressively outwardly from the hub flange wall toward the open end of the pulley; providing a new method, procedure and series of steps for manufacturing such one-piece, sheet metal multi V-grooved pulley structures; and providing a new pulley structure and a method of making such a pulley which achieves the stated objectives effectively and efficiently, and which solves problems and satisifies needs existing in the pulley spinning art.

These objectives and advantages may be obtained by the new pulley structure, the general nature of which may be stated as including a circular hub wall; an annular flange wall connected with the hub wall and extending generally axially from the hub wal and terminating in an open end opposite the hub wall; a series of outwardly opening V-shaped grooves formed in the annular flange wall, said grooves each being defined by a pair of inwardly angled side walls; each of the pairs of angled side walls of the series increasing in metal thickness from the open end of the annular flange wall toward the hub wall, with the metal thicknesses of each angled side wall of a pair being equal to the metal thickness of the other side wall of that pair; and conical wall means extending between and integrally joining the circular hub wall and annular flange wall.

The general nature of the new method of making the new pulley structure includes the step of providing a flat sheet metal disc blank having a central hole formed therein; clamping a central portion of the disc blank around the hole between opposed relatively axially movable complementary clamping faces of rotatable first headstock and tailstock die means wherein the first headstock die means also includes cylindrical flange-forming means having a series of cylindrical surfaces extending generally parallel to the axis of the headstock die means, and with the cylindrical surfaces having diameters increasing in dimension progressing away from the clamping face of the headstock die means; rotating the first die means and clamped disc blank; pressure rolling, forming and ironing the rotating annular disc blank metal portion surrounding the central portion against the first headstock die means cylindrical flange-forming means to form a cup-shaped stage blank with a flat bottom hub flange wall and a connected axially extending generally cylindrical side wall, the side wall having a series of integral cylindrical sections, said sections decreasing in metal thickness progressing away from the bottom hub flange wall toward the open end; removing the formed cup-shaped stage blank from the first headstock die means; mounting the cup-shaped stage blank on second headstock die means; rotating the second headstock die means and cup-shaped stage blank; and roller forming a plurality of pairs of inwardly extending V-groove flanges in the cylindrical side wall by pressure forming ironing the series of cylindrical sections against the second headstock die means, with each of the cylindrical sections providing the metal for a pair of the V-groove flanges and with said pairs of flanges forming V-shaped pulley grooves therebetween, whereby said V-groove flange pairs decrease in metal thickness progressing away from the bottom hub flange wall toward the open end.

BRIEF DESCRIPTION OF THE DRAWINGS

A preferred embodiment of the multi V-grooved pulley structure of the invention and of the new method of making such pulley — illustrative of the best mode in which applicant has contemplated applying the principles - are set forth in the following description and are shown in the drawings, and are particularly and distinctly pointed out and set forth in the appended claims.

FIG. 6 is a fragmentary, generally diagrammatic, sectional view showing the stage blank of FIG. 5 mounted between a second pair of headstock and tailstock dies of a spinning machine;

FIG. 7 is a view similar to FIG. 6 showing a trimming operation being performed on the open end of the completed intermediate stage blank of FIG. 5;

FIG. 8 is a view similar to FIG. 7 showing the step of forming a reentrant pulley groove flange in the conical wall of the intermediate stage blank of FIGS. 5–7;

FIG. 9 is a sectional view similar to FIG. 5 of the roller spun, cup-shaped final metal stage blank formed from the flat metal disc by the steps of FIGS. 1–8;

FIG. 10 is a greatly enlarged fragmentary sectional view of the lower portion of the cup-shaped stage blank of FIG. 9;

FIG. 11 is a fragmentary, generally diagrammatic sectional view showing the final stage blank of FIG. 9 being clamped by a tailstock die on a headstock die of a pulley groove, spin forming machine;

Similar numerals refer to similar parts thoughout the drawings.

DESCRIPTION OF THE PREFERRED EMBODIMENT

Figure 1:
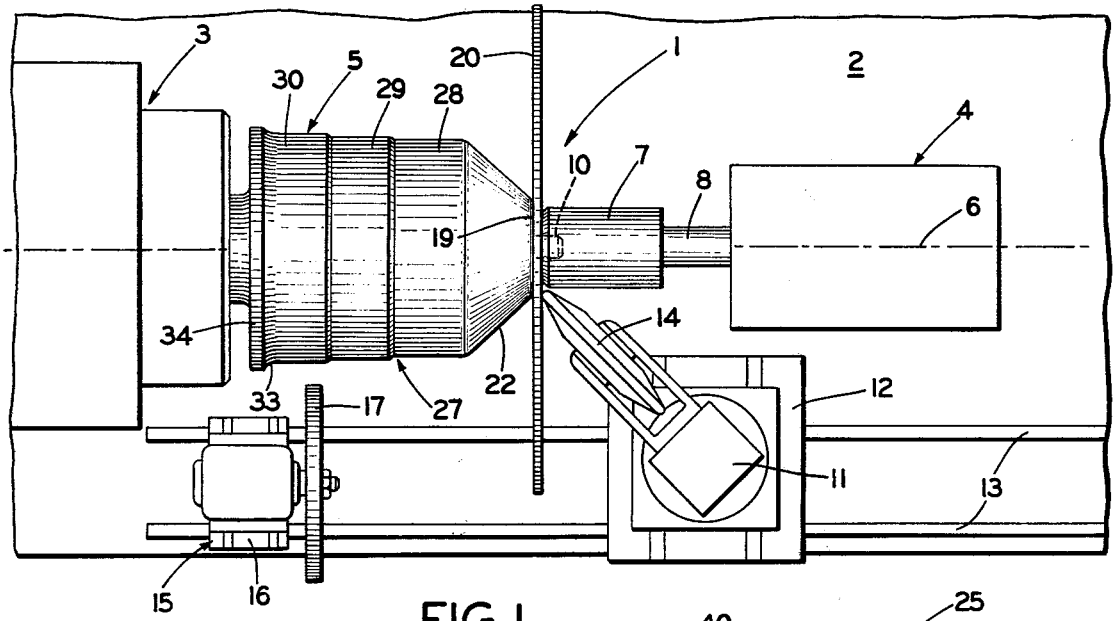
FIG. 1 is a fragmentary diagrammatic top plan view of portions of a type of simple spinning machine which may be used to carry out certain steps of the new procedure to produce the new pulley structure.

A portion of a typical simple lathe-type spinning machine for carrying out certain steps of the improved roller forming method to produce the improved pulley structure is shown in FIG. 1, and is indicated generally at 1. Spinner 1 includes a bed 2, a headstock assembly 3 and a tailstock assembly 4. A headstock die form 5 is mounted on headstock assembly 3 and is rotated by a motor driven shaft (not shown).

Figure 2:
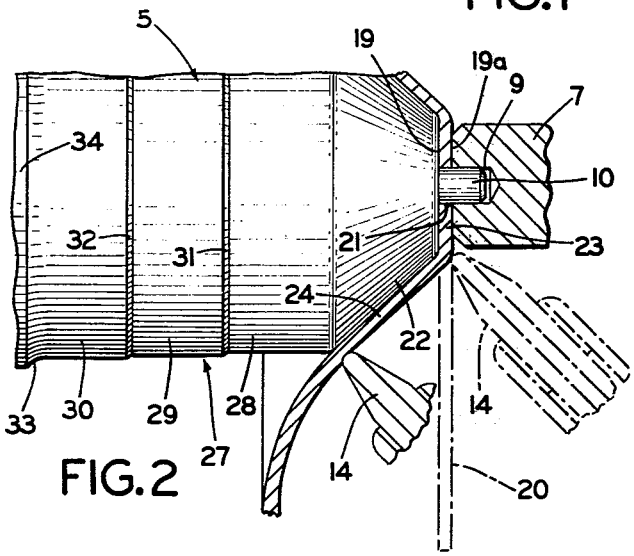
FIG. 2 is a somewhat diagrammatic sectional view of a flat sheet metal disc blank, shown in dot-dash lines, mounted between headstock and tailstock dies of the spinning machine shown in FIG. 1, and showing the spinning of an outwardly extending conical wall of a cup-shaped intermediate stage blank.

Tailstock assembly 4 preferably has a die form 7 axially movable by a piston rod 8. An aperture 9 is formed in tailstock die 7 for receiving a pilot pin 10 formed on and extending axially outwardly from the center of headstock die 5 (FIG. 2).

A tool holder 11 is movably mounted on a cross-feed carriage 12, which in turn is movably mounted on a pair of guide rods 13 for longitudinal axial movement between headstock and tailstock assemblies 3 and 4. A pressure spinning roller 14 is rotatably mounted on tool holder 11 and is movable both in parallel and transverse directions with respect to the longitudinal axis 6 of spinning machine 1 by manipulation along cross-feed carriage 12 and guide rods 13.

A metal trimming wheel assembly 15 may be mounted on a second cross-feed carriage 16, which in turn is mounted on guide rods 13. Assembly 15 includes a wheel 17 for trimming an edge portion of a cup-shaped metal blank produced in accordance with the procedure set forth below. Trimming assembly 15 may be of the type shown in U.S. Pat. No. 2,702,597.

Figure 14:
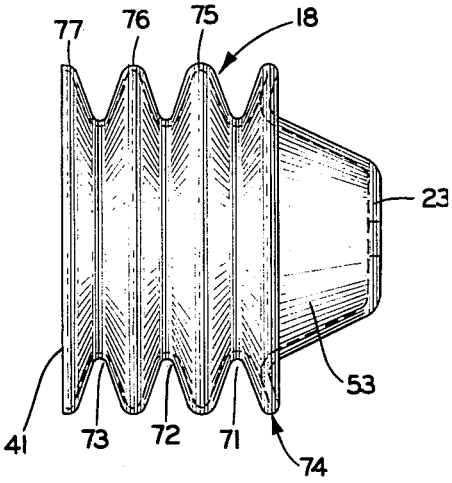
FIG. 14 is an elevational side view showing the new multi V-grooved pulley structure of the invention formed from the cup-shaped final stage blank of FIG. 9, in accordance with the steps of the improved roller spinning method shown in FIGS. 1–13.
Figure 13:
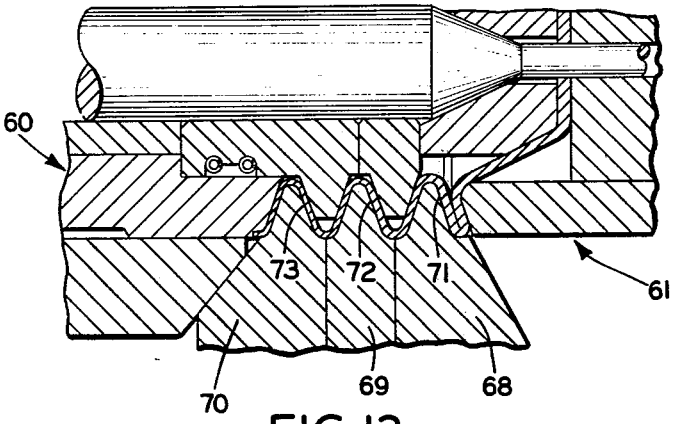
FIG. 13 is a fragmentary, generally diagrammatic, sectional view showing the roll finishing of the rough roll V-grooves of FIG. 12.

The particular construction and arrangement of roller spinning machine 1 and the components thereof may be modified and changed without affecting the concepts of the invention. The important features brought out by the construction of machine 1, as shown in FIG. 1, is the relative simplicity thereof in contrast with known complex prior art spinning machines used for a variety of spinning procedures. The improved roller spinning procedures for producing the improved multi V-grooved pulley structure of the invention is set forth diagrammatically in FIGS. 1–13. The new multi V-grooved pulley structure produced by the steps of the improved method of FIGS. 1–13 is shown in FIG. 14, and is indicated generally at 18.

A flat sheet metal disc blank 20 is clamped between a circular end face 19*a* of tailstock die 7 and a larger circular flat face 19 of headstock die form 5 by actuation of a cylinder or the like controlling piston rod 8. Pilot pin 10 projects through a central hole 21 formed in disc 20 and into aperture 9 of tailstock die 7 to properly align and center disc 20 of headstock die 5 of spinning machine 1.

The tool or roller 14 is guided into contact with a central portion of rotating blank disc 20 which is adjacent to and surrounds tailstock die 7 by the concurrent movement of cross-feed carriage 12 and tool holder 11 until pressure is exerted on disc 20. Roller 14 then moves in a transversely radially outwardly extending direction with respect to longitudinal axis 6 of machine 1 to the dot-dash line position FIG. 2. Roller 14 forces an annular portion of disc 20, surrounding the clamped central portion, against the outer periphery of flat end face 19 of die 5. Carriage 12 then moves longitudinally along guide rods 13 forwardly toward headstock die 5 simultaneously with the radial outward movement of tool holder 11. Roller 14 follows a general diagonal path along headstock die 5 from the dot-dash line position of FIG. 2 to the full line position thereof.

Roller 14, by one or a series of passes, with respect to headstock die 5, works, irons and forms intermediate annular portions of disc 20 which surrounds the clamped central portion against the outer portion of flat end face 19 and against an outwardly extending conical flange forming surface 22 of headstock die 5. This working forms a flat bottom hub flange wall 23 and a conical wall 24 of an intermediate cup-shaped stage blank 25, shown particularly in FIG. 5.

Sufficient pressure is exerted by roller 14 on disc 20 during this movement along headstock die form 5 to iron out any indentation, gage variation or other irregularity of disc 20 to form the dynamically balanced central flat bottom hub flange wall 23 and conical wall 24. Conical wall 24 preferably is sheer spun formed, whereby the metal is thinned so that the thickness, when measure in the axial direction indicated at "*t*", FIG. 3, is generally equal to the thickness "*t*" of the original disc blank and of hub wall 23.

Figure 3:
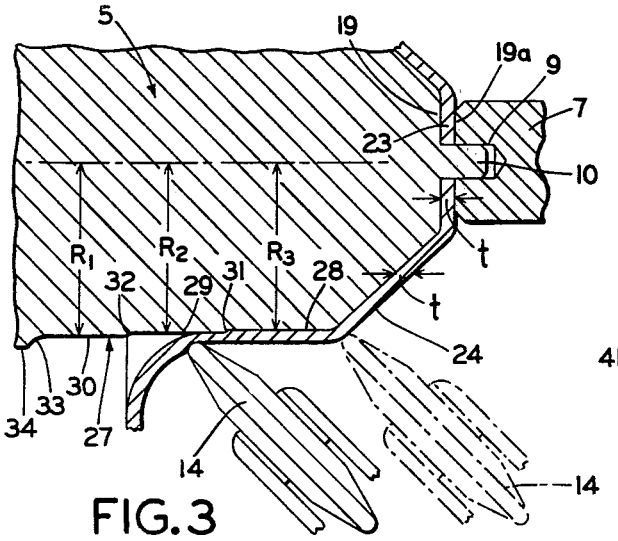
FIG. 3 is a view similar to FIG. 2 showing a step of the improved roller spinning operation in which an outer annular end portion of the disc blank is being laid along a stepped cylindrical side wall of the headstock die form by the forming roller.
Figure 4:
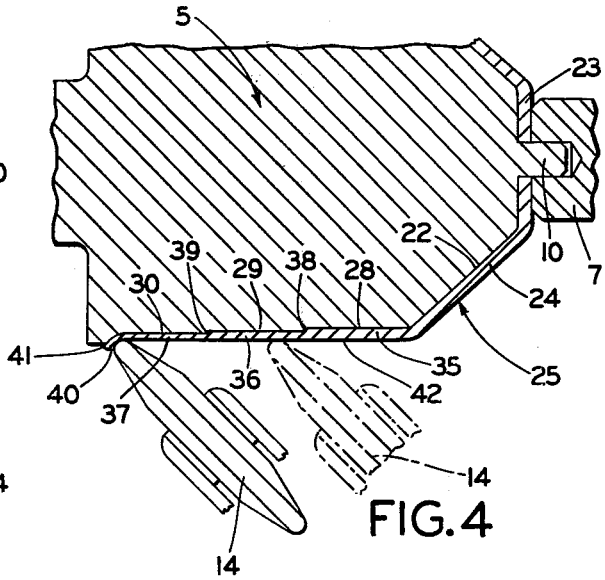
FIG. 4 is a view similar to FIG. 3 showing the completion of the roller forming of the cylindrical side wall of the cup-shaped intermediate stage blank.
Figure 12:
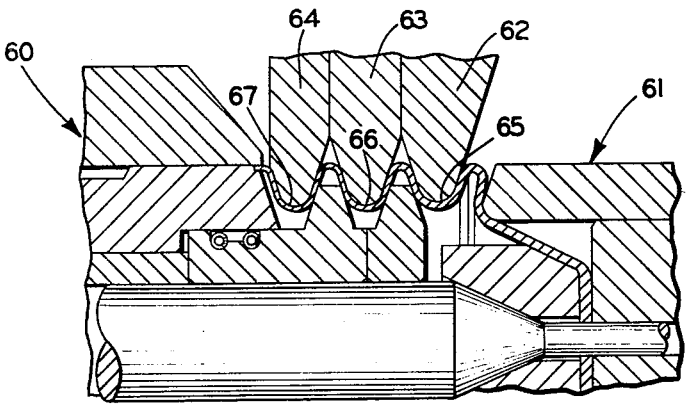
FIG. 12 is a fragmentary, generally diagrammatic, sectional view showing the formation of a plurality of rough roll formed V-grooves in the stepped cylindrical side wall of the cup-shaped metal stage blank of FIG. 9.

In accordance with the invention, the next series of operations and steps of the improved process forms a cylindrical side wall 26 of intermediate cup-shaped stage blank 25 (FIGS. 3 and 4). Roller 14 moves axially along headstock die form 5 from the dot-dash line position of FIG. 3 to the full line position of FIG. 4 and forms, irons and pressure rolls an outer annular end portion of disc 20 along and against a cylindrical flange forming side wall 27 of headstock die form 5. Die side wall 27 includes a series of cylindrical surfaces 28, 29 and 30 which are integrally connected by upwardly rearwardly angled annular surfaces 31 and 32 (FIG. 2). Surfaces 28, 29 and 30 are arranged in a step-like fashion extending from conical die flange-forming surface 22, rearwardly to an outwardly extending arcuate surface 33, which terminates in a cylindrical axially extending surface 34.

The radii of cylindrical die surfaces 28, 29 and 30 increase progressively rearwardly from adjacent flat end face 19 rearwardly toward arcuate surface 33 (FIG. 3) with the radii increase being equal to the vertical height of angled annular surface 31 and 32. Thus, $R_1$ is greater than $R_2$, which in turn is greater than $R_3$, as shown in FIG. 3. The axial lengths of cylindrical surfaces 28, 29 and 30 preferably are equal.

Figure 5:
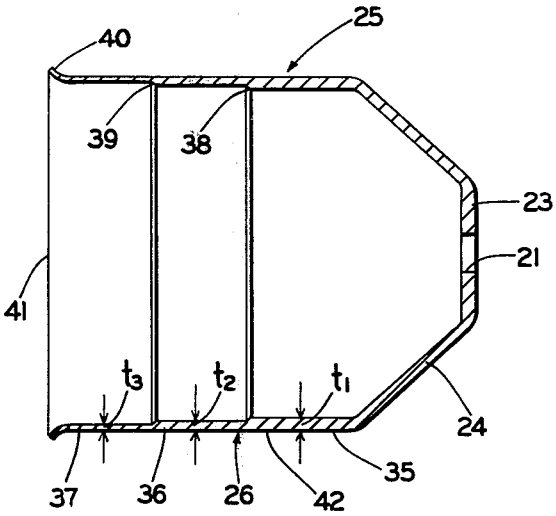
FIG. 5 is a sectional view of the dynamically balanced, roller spun cup-shaped intermediate stage blank formed from the flat metal disc by the roller spinning steps shown in FIGS. 1–4.

This metal working of disc 20 along die side wall 27 forms the axially extending cylindrical side wall 26 of intermediate cup-shaped blank 25 which is integrally connected to hub flange wall 23 by conical wall 24. Cup side wall 26 is formed with three integrally connected cylindrical side wall sections 35, 36 and 37 due to the working of the disc metal along die cylindrical sufaces 28, 29 and 30, respectively (FIGS. 4 and 5). Side wall sections 35 and 36 are joined by an angled conical surface 38 formed by the working of the metal against angled annular die surface 31, with cylindrical side wall sections 36 and 37 being joined by a similarly shaped angled surface 39 formed by the working of the metal against angled annular die surface 32. Cylindrical side wall section 37 terminates in an outwardly curved terminal flange 40 formed by movement of the metal along arcuate die surface 33. Flange 40 defines an open end 41 of intermediate stage blank 25.

The outer surface 42 of cylindrical side wall 26 preferably is maintained parallel to axis 6 of headstock die form 5 and correspondingly, parallel to the axis of intermediate stage blank 25. Thereby, in accordance with one of the main features of the invention, cup side wall sections 35, 36 and 37 are formed with decreasing metal thickness progressing from conical wall 24 toward open cup end 41. Referring to FIG. 5, the metal thicknesses of cylindrical sections 35, 36 and 37, are indicated at $t_1$, $t_2$ and $t_3$, respectively, with $t_1$ being greater than $t_2$ and correspondingly, $t_2$ being greater than $t_3$. The axial lengths of $t_1$, $t_2$ and $t_3$ preferably are equal to each other.

Intermediate cup-shaped stage blank 25 also may be described as consisting of a circular hub flange wall 23, an outwardly extending conical wall 24 which terminates in a generally cylindrical side wall 26 having a stepped interior surface, and in which the metal thickness of side wall 26 increases in a step-like fashion from open cup end 41 toward conical wall 24.

The next series of operations and steps of the improved process forms a final cup-shaped stage blank 45 in which a reversely angled, reentrant flange 46 is formed in conical wall 24 adjacent cylindrical side wall section 35, and in which terminal flange 40 is trimmed from cylindrical side wall section 37.

Intermediate stage blank 25 is removed from headstock die form 5 and is placed on a second headstock die form 47 and clamped thereon by a tailstock die form 48 (FIG. 6). Clamped stage blank 25 is rotated with headstock and tailstock dies 47 and 48 with terminal flange 40 being removed in a trimming operation. Wheel 17 of trim assembly 15 moves radially inwardly on a cross-feed carriage 16 to shear flange 40 from side wall 26 and to form cylindrical section 37 to a predetermined axial length, as shown diagrammatically in FIG. 7. Die 47 preferably has an annular shoulder 49 in which a trimming blade 50 is mounted, which cooperates with wheel 17 for trimming end flange 40 as described in Pat. No. 2,702,597.

A forming roller 51 next moves generally simultaneously inwardly and rearwardly from the dot-dash line position to the full line position of FIG. 8. Roller 51 forms and irons the metal of conical wall 24 along and against a conical wall 52 of headstock die 47 to form an outwardly extending conical wall 53 of final stage blank 45. Conical wall 53 forms a smaller angle with hub wall 23 than did conical wall 24 and has a shorter length, as can be seen by a comparison of FIGS. 5 and 9.

Roller 51 then forms, irons and presses the outer portion of the metal of conical wall 24 into an acutely angled corner 54 formed in die form 47 which connects conical die wall 52 with a reentrant conical flange-forming die wall 56. This working forms a complementary acute angled corner 57 and conical reentrant flange 46 in conical wall 24, adjacent cylindrical side wall 26.

FIG. 10 is an enlarged sectional view of a portion of side wall 26 of final cup-shaped stage blank 45, together with adjoining portions of conical wall 53 and hub wall 23, illustrating the stepped thicknesses of cylindrical sections 35, 36 and 37.

The dynamically balanced cup-shaped final stage blank 45 of FIG. 9 then is removed either manually or automatically from die form 47 and placed on a pulley forming headstock die assembly 60, only a portion of which is shown in FIG. 11, and is clamped thereon by a tailstock die assembly 61 of a pulley groove forming machine. Headstock and tailstock die assembly 60 and 61 may be of the type shown and described in U.S. Pat. No. 3,908,421.

The next series of steps of the improved process (FIGS. 11, 12 and 13) form a plurality of V-grooves in cylindrical side wall 26 of final stage blank 45 is forming the new pulley structure 18 of the invention (FIG. 14). Stage blank 45 is rotated by headstock and tailstock die 60 and 61, and a plurality of rough V-groove forming rolls 62, 63 and 64 (FIGS. 11 and 12) are moved transversely radially inwardly, engaging the midpoints of cylindrical side wall sections 35, 36 and 37, respectively, of pulley blank 45. The continued inward movement of rolls 62, 63 and 64, together with the inward axial movement of outer rolls 62 and 64, in combination with the axial movement of tailstock die assembly 61, form rough V-grooves 65, 66 and 67 (FIG. 12) in stage blank wall 26. A plurality of finishing pulley groove-forming rolls 68, 69 and 70, which preferably are mounted diametrically opposite rough forming rolls 62, 63 and 64, move transversely into rough V-grooves 65, 66 and 67, respectively (FIG. 13), to finish form the rough V-grooves into final finished V-grooves 71, 72 and 73, respectively.

Figure 15:
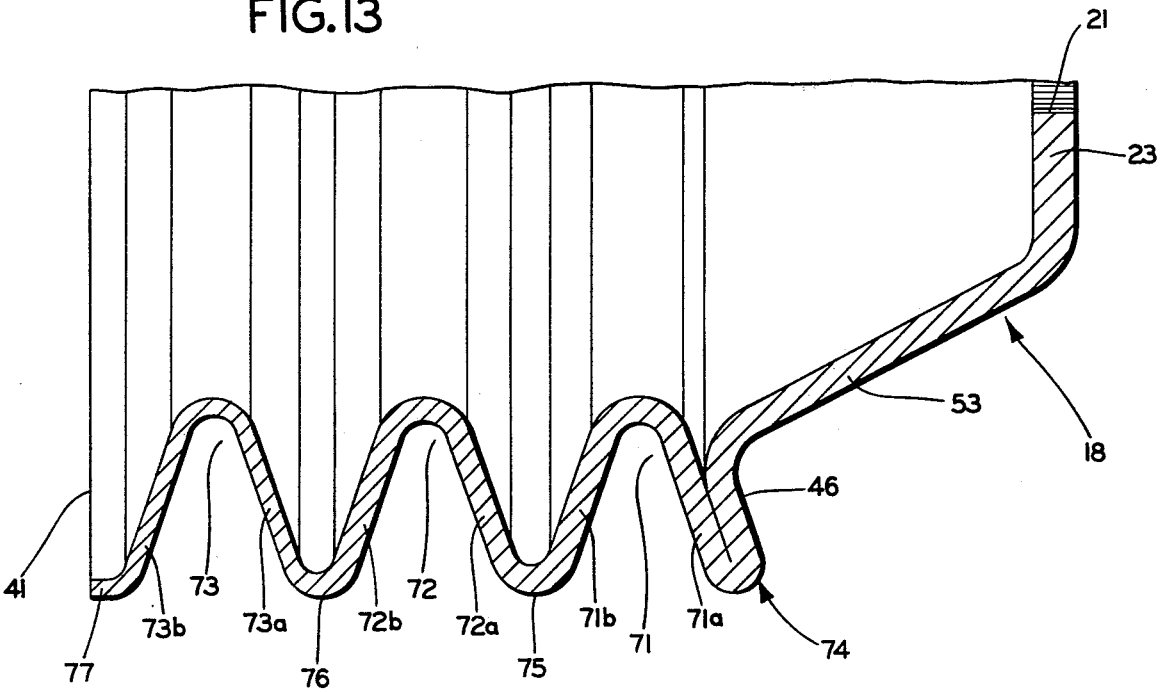
FIG. 15 is a greatly enlarged fragmentary, sectional view of the lower portion of the improved pulley structure of FIG. 14.

In accordance with one of the main features of the improved method and pulley structure, cylindrical side wall sections 35, 36 and 37, each of which has a uniform metal thickness, form the V-groove flange walls 71*a*–71*b*, 72*a*–72*b*, and 73*a*–73*b* of finished V-grooves 71, 72 and 73, respectively (FIG. 15). Reentrant flange 46 forms a double thickness flange wall, indicated generally at 74, of V-groove 71, together with matching second flange wall 71*a*.

The metal thicknesses of the individual V-groove forming flange walls are equal to each other for each V-groove since the metal for each V-groove is provided by one of the cylindrical side wall sections. Thus, the metal thickness of flange wall 73*a* equals that of 73*b*, the metal thickness of flange wall 72*a* equals that of 72*b*, and the metal thickness of flange wall 71*a* equals that of flange wall 71*b*.

The adjacent flange walls of the adjacent V-grooves are joined by intervening rounded crests 75 and 76, with crest 75 joining flange walls 71*b* and 72*a*, and crest 76 joining flange walls 72*b* and 73*a* (FIG. 15). The metal thicknesses of crests 75 and 76 vary in a smooth contour to compensate for the differences in metal thicknesses existing between the adjacent V-groove flange walls. Crests 75 and 76 are formed in the areas defined by angled cup wall surfaces 38 and 39, which join the cylindrical side wall sections 35, 36 and 37 of stage blanks 25 and 45, as shown in FIG. 10.

Endmost flange wall 73*b* preferably terminates in an axially extending cylindrical flange 77 which defines open end 41 of pulley 18, and provides strength and rigidity to the series of V-grooves 71–73 formed in cylindrical wall 26.

One example of the new pulley structure 18 produced by the steps of the new procedure is formed from a sheet metal disc blank having an approximate diameter of 8.8 inches and a thickness of 0.152 inches. The hub flange wall 23 of the resulting pulley 18 has a metal thickness of approximately 0.152 inches, with conical flange wall 53 having a thickness of approximately 0.090 inches, with flange wall 71*a* and 71*b* each having a thickness of approximately 0.085 inches, flange wall 72*a* and 72*b* having an approximate metal thickness of 0.075 inches, and with flange wall 73*a* and 73*b* having an approximate metal thickness of 0.065 inches. Double thickness flange wall 74 in turn would have a total metal thickness of approximately 0.175 inches. Thereby, flange walls 71*a*–71*b* are able to withstand greater forces and stresses due to the thicker metal than the flange walls forming pulley grooves 72 and 73. Likewise, flange walls 72*a*–72*b* are able to withstand greater forces and stresses than flange walls 73*a*–73*b* which form groove 73.

Fundamental facets of the new concept involve the procedure for the spinning operations and the manufacture of a dynamically balanced cup-shaped pulley blank with the formation of a cylindrical wall formed by a plurality of integral stepped cylindrical sections, the metal thicknesses of which decrease progressively from the hub flange wall toward an open end of the cup-shaped blank; in which the cylindrical wall sections provide the metal for a plurality of V-grooves roll spun in the cup-shaped blank to form a final spun metal improved multi V-grooved pulley structure, in which the metal thicknesses of the pulley groove forming flange walls decrease in thickness progressively from the hub end toward the open end of the pulley. Considerable metal saving is achieved by reducing the diameter of the starting flat disc metal blank from which the cup-shaped stage blank and subsequent pulley structure is formed. Furthermore, a pulley structure is provided wherein the metal thicknesses of the pulley groove-forming walls are greater adjacent the pulley hub than the thicknesses of the groove-forming walls at the outer end, enabling the pulley structure to be able to withstand the greater forces and stresses on the metal, which are greater in the area adjacent the pulley hub than adjacent the open or outer end of the pulley.

The spinning machines used for carrying out the steps of the improved method are of relatively simple and inexpensive construction and preferably will be controlled and programmed by pneumatic, hydraulic and electronic components and devices well known in the spinning art. An operator need only actuate a cycle start button causing tool holder 11, trimming assembly 15 and groove forming mechanism 60–64 and 68–70 to advance through a programmed series of operations to completely spin form cup-shaped blanks 25 and 45, and improved pulley structure 18. Likewise, if desired, headstock die 5 need only be replaced by headstock die 47 with a subsequent reprogramming of the machine control cycle to change from production of intermediate stage pulley blanks 25 to final stage pulley blanks 45, with the subsequent groove forming operation of headstock and tailstock die 60 and 61 being performed on a separate spinning machine.

Cylindrical wall 26 of cup-shaped blanks 25 and 45 need not be joined to hub wall 23 by conical walls 24 and 53, respectively, and can be joined by a cylindrical hub wall portion with or without a reentrant flange or by other configurations, if desired, without departing from the concept of the invention. Also, the cup-shaped stage blanks and subsequent pulley structure need not have three pulley grooves formed therein, as shown in the drawings and described above, but may have two, three, four or more depending upon the particular configuration and intended use of the final desired pulley structure.

The metal spin forming of the intermediate cup-shaped stage blank 25, shown particularly in FIGS. 1-4, need not be formed by a single roller 14 in a series of passes. If desired, blanks 25 may be formed in a single pass by two or more rolls of the type shown and described in my copending application, Ser. No. 671,132, filed Mar. 29, 1976, which spinning method forms no part of the present invention, but can provide an acceptable metal spin forming procedure for producing such cup-shaped stage blanks.

The new one-piece, cup-shaped spun metal multi V-grooved structure described, and in particular, coordinated and interrelated procedure of making the pulley with the special groove forming flange walls with varying thickened metal portions, provides a pulley and methods of making the pulley which may be manufactured and used easily and inexpensively with simple dies, and produces products and utilizes procedures which achieve the stated objectives, eliminates difficulties in pulley weaknesses heretofore existing in the art, and solves problems and obtains the new results indicated.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown are described.

Having now described the features, discoveries and principles of the invention, the particular new combination of structural features of the new multi V-grooved pulley, the related procedural steps by which the improved pulley may be made, and the advantageous, new and useful results obtained; the new and useful structures, devices, elements, arrangements, procedures, methods and steps in the manufacture of the pulley are set forth in the appended claims.

I claim:

1. A one-piece, sheet metal multi V-grooved pulley structure including:

a. a circular hub wall;

b. an annular flange wall connected with the hub wall and extending generally axially from the hub wall and terminating in an open end opposite the hub wall;

c. a series of outwardly opening V-shaped grooves formed in the annular flange wall, said grooves each being defined by a pair of inwardly angled side walls;

d. and each of the pairs of angled side walls increasing in metal thickness from the open end toward the hub wall of the annular flange wall.

2. The pulley structure defined in claim 1 in which the metal thickness of one angled side wall of a certain pair is equal to the metal thickness of the other side wall of that pair.

3. A one-piece, sheet metal, multi V-grooved pulley structure including:

a. a circular hub wall;

b. an annular flange wall extending generally axially from the hub wall and terminating in an open end opposite the hub wall;

c. a conical wall extending between and integrally joining the hub wall and the annular flange wall;

d. a series of outwardly opening V-shaped grooves formed in the annular flange wall, said grooves each being defined by a pair of inwardly angled side walls, with each of the pairs of angled side walls increasing in metal thickness from the open end toward the hub wall of the annular flange wall;

e. the V-groove forming angled side wall adjacent the conical wall having a double wall thickness; and f. a reentrant flange formed in the conical wall providing one wall thickness of the double thickness V-groove forming angled side wall.

4. The pulley structure defined in claim 3 in which the conical wall extends outwardly from the hub wall toward the series of V-grooves.

5. A one-piece, sheet metal multi V-grooved pulley structure including:

a. a circular hub wall;

b. an annular flange wall connected with the hub wall and extending generally axially from the hub wall and terminating in an open end opposite the hub wall;

c. a series of outwardly opening V-shaped grooves formed in the annular flange wall, said grooves each being defined by a pair of inwardly angled side walls;

d. each of the pairs of angled side walls increasing in metal thickness from the open end toward the hub wall of the annular flange wall;

e. the adjacent groove forming angled side walls of adjacent V-grooves being integrally joined by groove crests; and f. the metal thickness of the groove crests varying to provide for the differences in metal thicknesses of the adjacent groove forming angled side walls.

6. The pulley structure defined in claim 5 in which the metal thickness of one angled side wall of a certain pair is equal to the metal thickness of the other side wall of that pair.

7. The pulley structure defined in claim 6 in which the open end of the annular flange wall is defined by an axially extending cylindrical flange.

8. The pulley structure defined in claim 6 in which a conical wall extends outwardly from the hub wall and integrally joins the hub wall and the series of V-grooves formed in the annular flange wall; and in which the V-groove forming angled side wall adjacent the conical wall has a double wall thickness; and in which a reentrant flange is formed in the conical wall and forms one wall thickness of said double thickness V-groove forming angled side wall.

9. The pulley structure defined in claim 5 in which the open end of the annular flange wall is defined by an axially extending cylindrical flange.

10. In a method of making a spun sheet metal pulley of the type having a bottom hub flange wall and an outer generally cylindrical side wall terminating in an open end, from a flat sheet metal disc blank, including the steps of:

a. providing a flat sheet metal disc blank having a central hole formed therein;

b. clamping a central portion of the disc blank around the hole between opposed relatively axially movable complementary clamping faces of rotatable first headstock and tailstock die means wherein the first headstock die means also includes cylindrical flange wall forming means having a series of cylindrical surfaces extending generally parallel to the axis of the headstock die means, and with said cylindrical surfaces having diameters increasing in dimension progressing away from the clamping face of the headstock die means;

c. rotating the first die means and clamped disc blank;

d. pressure rolling, forming and ironing an annular portion of the rotating disc blank metal surrounding the central portion against the first headstock die means cylindrical flange wall forming means to form a cup-shaped stage blank with a flat bottom hub flange wall and a connected axially extending generally cylindrical side wall, to form said side wall with a series of integral cylindrical sections, and to form said sections with decreasing metal thickness progressively away from the bottom hub flange wall;

e. removing the formed cup-shaped stage blank from the first headstock die means;

f. mounting the cup-shaped stage blank on second headstock die means;

g. rotating the second headstock die means and cup-shaped stage blank; and h. roller forming a plurality of pairs of V-groove flanges in the cylindrical side wall by pressure forming and ironing the series of cylindrical sections against the second headstock die means to form each of said cylindrical sections with a pair of V-groove flanges providing adjacent V-shaped pulley grooves, whereby said pulley groove V-groove flange pairs decrease in metal thickness progressively away from the bottom hub flange wall.

11. The method set forth in claim 10 including the additional steps of providing the first headstock die means with conical flange wall forming means extending between the clamping face and cylindrical flange wall forming means; and forming a conical wall in the stage blank extending between the hub wall and cylindrical side wall by pressure rolling, forming and ironing an intermediate annular portion of the rotating disc blank against the die means conical flange wall forming means.

12. The method set forth in claim 11 including the further steps of removing the stage blank from the first headstock die means after forming the conical wall; clamping the hub flange wall on a rotatable second headstock die means having reentrant conical flange wall forming means formed thereon; rotating the clamped stage blank and second headstock die means; and forming an annular reversely angled conical flange wall connecting the conical flange wall and cylindrical side wall of the stage blank by pressure rolling, forming and ironing a portion of the conical wall of the stage blank against the die means reentrant conical flange wall forming means.

13. The method set forth in claim 12 in which, during the step of forming the pairs of V-groove flanges in the cylindrical side wall, the reversely angled conical flange wall and the stage blank V-groove flange adjacent the conical flange wall are cold worked to form a double thickness wall.

14. The method set forth in claim 10 in which, during the step of forming the V-groove flanges in the cylindrical side wall, intervening rounded crests varying in metal thickness are formed in the metal in areas of the junctions of adjacent cylindrical sections of the series to provide a smooth transition between the different metal thicknesses of adjacent V-groove flanges of adjacent pulley V-grooves.

15. The method set forth in claim 10 in which, during the step of forming the cylindrical side wall of the cup-shaped stage blank, the cylindrical side wall is formed with an outer surface parallel with the axis of the cup-shaped stage blank, and a step-like inner surface formation is formed on the cylindrical side wall against the series of die means and cylindrical flange wall forming means of the first headstock means.

16. The method set forth in claim 10 including the step of trimming the extended end of the cylindrical side wall to a predetermined axial length prior to forming the pulley V-grooves.

17. In a method of making a spun V-grooved sheet metal pulley, including the steps of:

a. pressure roll forming a bottom hub flange wall and a generally axially extending side wall terminating in an open end in a single flat sheet metal disc blank to provide a cup-shaped stage blank, and during the stage blank roll forming step providing a plurality of integral cylindrical sections of increasing metal thicknesses progressively in the cylindrical side wall from the open end toward the hub flange wall;

b. trimming an extended end of the cylindrical side wall which defines the open end; and c. roller forming a plurality of V-grooves in the cylindrical side wall by pressure roll forming and ironing the metal in each of the several cylindrical sections into pairs of V-groove forming flanges; whereby the metal thickness of successive flange pairs increase progressively, from the open end toward the hub flange wall.

18. The method defined in claim 17 including the additional steps of forming the cup-shaped stage blank with a conical wall extending between and integrally joining the hub wall and cylindrical side wall by pressure rolling during the stage blank forming step; and forming a reentrant, reversely angled conical wall portion in the conical wall by pressure rolling and ironing a portion of the conical wall of the stage blank against reentrant conical flange wall forming means provided in the headstock die means, the reentrant conical flange wall portion and the V-groove flange adjacent said reentrant flange wall portion are cold worked to form a double thickness wall.

* * * * *

UNITED STATES PATENT AND TRADEMARK OFFICE

CERTIFICATE OF CORRECTION

PATENT NO. : 4,050,321

DATED : Sept. 27, 1977

INVENTOR(S) : Derald H. Kraft

It is certified that error appears in the above-identified patent and that said Letters Patent are hereby corrected as shown below:

Column 2, line 34, word "wal" should read "wall"

Column 3, line 7, add word "and" after word "forming"

Column 5, line 33, word "measure" should read "measured"

Column 5, line 67, word "sufaces" should read "surfaces"

Column 7, line 14, word "is" should read "in"
Column 9, line 36, word "are" should read "or"
Column 10, line44, number "6" should read "5"

Signed and Sealed this

*Twenty-seventh* Day of *December 1977*

[SEAL]

*Attest:*

RUTH C. MASON
*Attesting Officer*

LUTRELLE F. PARKER
*Acting Commissioner of Patents and Trademarks*